US006663718B1

(12) United States Patent
Mush

(10) Patent No.: US 6,663,718 B1
(45) Date of Patent: Dec. 16, 2003

(54) INTERNAL COMBUSTION ENGINE CLEANING APPARATUS AND METHOD

(76) Inventor: Paul George Mush, 2 Blue Bird La., Mill Valley, CA (US) 94941

( * ) Notice: Subject to any disclaimer, the term of this patent is extended or adjusted under 35 U.S.C. 154(b) by 0 days.

(21) Appl. No.: 09/591,934

(22) Filed: Jun. 12, 2000

(51) Int. Cl.[7] ..... B08B 7/02

(52) U.S. Cl. ..... 134/1; 134/10; 134/20; 134/22.1; 134/169 A; 134/184; 123/198 A

(58) Field of Search ..... 134/1, 22.1, 10, 134/169 A, 184, 186; 123/198 A

(56) References Cited

U.S. PATENT DOCUMENTS 3,173,034 A * 3/1965 Dickey et al. ..... 134/184
4,716,879 A * 1/1988 Takayama et al. ..... 123/590
5,119,775 A * 6/1992 Kokubo et al. ..... 123/179.16
5,179,923 A * 1/1993 Tsurutani et al. ..... 123/435
5,232,513 A * 8/1993 Suratt et al. ..... 134/22.1
5,295,497 A * 3/1994 Skovron ..... 134/169 A
5,383,481 A * 1/1995 Waelput ..... 134/56 R
6,041,798 A * 3/2000 Grigorian et al. ..... 134/169 A
6,263,889 B1 * 7/2001 Flynn et al. ..... 134/169 A

* cited by examiner

*Primary Examiner*—Randy Gulakowski
*Assistant Examiner*—Saeed Chaudhry
(74) *Attorney, Agent, or Firm*—Risto A. Rinne, Jr.

(57) ABSTRACT

An apparatus and method for cleaning the interior portions of an internal combustion engine includes an ultrasonic cleaning machine that supplies a heated cleaning solution to the engine or to a sub-system of the engine through a first adapter that connects to a first orifice of the engine, for example, to the oil filter port. A second adapter connects to a second orifice of the engine, for example, to the oil drain port, and includes an ultrasonic transducer. After the cleaning solution has been supplied to the engine, the ultrasonic transducer is energized for a predetermined period of time to impart ultrasonic energy to the cleaning solution in the engine to improve cleaning efficacy. When complete, the cleaning solution and adapters are removed from the engine. Then the proper fluid, for example, fresh motor oil is added along with a new oil filter.

16 Claims, 1 Drawing Sheet

INTERNAL COMBUSTION ENGINE CLEANING APPARATUS AND METHOD

BACKGROUND OF THE INVENTION

1. Field of the Invention

The present invention, in general, relates to engine cleaning equipment and methods and, more particularly, to devices that utilize ultrasound to clean internal combustion (hereinafter "IC") engines, including the various sub-systems associated with IC engines.

The thorough cleaning of IC engines and the sub-systems they have can prolong their life expectancy and improve their reliability. Wherever there is a fluid associated with an IC engine, it can be regarded as part of a particular sub-system that is either necessary or useful to the functioning of the engine. Certainly, one of the most common sub-systems involves the lubrication of the IC engine and it is so important to the engine's operation and longevity that the lubrication of an IC engine is generally regarded as an essential type of a sub-system for an IC engine.

With all IC sub-systems that involve the use of a fluid, eventually it becomes necessary to change that fluid. For example, in an IC engine, both the engine oil (i.e., lubricating oil) and the oil filter are periodically changed.

However, merely changing the oil and filter does not adequately clean sludge and other deposits from the interior portions of these engines. Various contaminants such as sludge, varnish, gum, metal and other deposits remain in the engine after the oil and filter have been changed where they may continue to contribute to rapid and excessive engine wear. It is desirable to remove these from the engine so as to limit their deleterious effects.

Accordingly, equipment has been designed and is therefore known to aid in cleaning the interior of an IC engine. Typically, these types of devices (i.e., cleaning machines) connect to the engine through various types of adapters that attach where desired to the engine.

Common areas of connection are at the oil filter port and also simultaneously at the oil drain pan (i.e., the oil drain plug hole) thereby creating a "circuit". A cleaning solution is pumped in under pressure through one of the adapter locations. This is done either after the oil has first been drained (i.e., removed from the engine) or, alternatively, it could conceivable occur during the oil change process itself.

The cleaning solution may be required to remain in the engine for a time and then it is flushed out. A rinse solution may be pumped in after the cleaning solution has been used to aid in removing both the cleaning solution and any sludge or other contaminants that have been loosened from the engine. After the cleaning and rinse solutions have been drained from the engine, the adapters are removed, the new oil filter and drain plug are installed, and new engine oil is added to complete the cleaning process.

There is potential for cleaning any part inside of an IC engine that any of the fluids of any of the sub-systems may contact. This includes, considering for example the fuel sub-system, any area that the fuel (or resultant combustion gases which are also considered to be part of the "fluid" path) may contact such as the heads, cylinders, pistons, fuel injectors, throttle bodies, etc. The advantage of cleaning in this manner is that disassembly of the engine is not generally required (other than where the various adapters are installed).

Similarly to aid in cleaning the various other types of sub-systems and their respective fluids equipment, cleaning solutions, or processes have, in general, been used. Some of these remaining IC engine sub-systems include the cooling (i.e., coolant), transmission, power steering, differential, and braking systems. Sometimes IC engines are used specifically to power simple to elaborate hydraulic based sub-systems such as are found, for example, on tractors and other agricultural or construction types of equipment and vehicles. The hydraulic sub-system likely would also benefit from a periodic "deep" cleaning.

For example, it is generally well known to "reverse-flush" the coolant system of an IC engine to aid in cleaning it by running a fluid in an opposite direction as compared to the direction that it is normally circulated throughout the engine.

However, all of these processes have heretobefore incurred various disadvantages. The first and most significant is that they are not optimally effective. Sludge and other contaminants are often difficult to dislodge from the surfaces that they are attached to and may therefore be especially difficult to flush out and remove from the engine.

Therefore, the cleaning solutions may be required to sit for a period of time in contact with the sludge and other contaminants to improve their efficacy. This, in turn, slows down the cleaning process which drives up the cost of cleaning.

There are effective devices and methods known for cleaning parts that rely upon the use of ultrasonic devices that impart ultrasound (i.e., high frequency longitudinal vibrational energy) to a fluid. The fluid may also include a cleaning solution. An object (i.e., a part) that is to be cleaned is placed in the cleaning solution. The ultrasound energy alternately impacts and cavitates upon the surface of the object so as to effectively and quickly clean it.

But for these ultrasonic cleaning devices to function, the object that is to be cleaned must first be disassembled into its component parts. It is then necessary to place these smaller component parts in the cleaning solution of the ultrasonic cleaning device.

Obviously, it is not practical to disassemble an IC engine or any of the sub-systems it uses into their component parts in order to clean all of the components parts. Nor is it practical to reassemble the engine or sub-system after such a cleaning. Cost, time, and liability (arising from either losing, damaging, or errors in reassembling) pose too serious of a drawback.

Neither is it practical to remove an entire engine and place it in a very large ultrasonic type of a cleaning apparatus. Therefore, the use of ultrasound to clean the interior portions of an IC engine has not previously been available in a practical way to utilize its benefits.

Wherever there is an IC engine and a fluid (or a combustion gas), it will be either necessary or desirable to clean it. Certain applications can be especially difficult to service. For example, the various fluids used on marine IC engines often cannot be drained under the influence of gravity (i.e., because the fluid cannot be dumped into a boat or in the water) and therefore it must be flushed out under pressure and captured. Other applications that employ IC engines have similar or other problems.associated with cleaning them and their respective sub-systems.

Accordingly, there exists today a need for an internal combustion engine cleaning apparatus and method that can be used to quickly and effectively to clean the various interior portions of an IC engine. Such an apparatus and method is desirable for use also in cleaning the various sub-systems of an IC engine. It is preferable to lessen the amount of disassembly that is required to do so.

Clearly, such an apparatus and method would be especially useful and desirable.

2. Description of Prior Art

Cleaning devices and methods are, in general, known. For example, the use of engine oil flush cleaning systems are known. One such system is known as "Renew Engine Power Flush System™" and is offered by Ontario Limited at 1180 Stellar Drive, Unit 10, Newmarket, Ontario, L3Y 7B9.

Commercially available cleaning solutions are also available to aid in the cleaning of the lubricating system and other sub-systems of an IC engine.

Other devices and methods (known generally as "flush machines" or "oil flush machines" are available for cleaning the various sub-systems. For example, an oil flush machine may require pumping a heated cleaning solution into an engine, circulating and filtering the solution, and after approximately 10 minutes of doing so (with or without the engine running) removing and collecting the solution and adding fresh motor oil.

As another example, reverse flush systems are available for cleaning the cooling system. Flush machines are adaptable for use with other systems like the transmission and cooling sub-systems, for example.

Alternatively, various chemicals and other solutions may also be added to the engine crankcase and, after a time of engine operation, disposed of with the engine oil to provide other known types of products and methods.

Other types of decarbonization and fuel system cleaners (both chemical and machine based) are also known.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an internal combustion engine cleaning apparatus and method that can be used to clean the interior surfaces of an IC engine.

It is also an important object of the invention to provide an internal combustion engine cleaning apparatus and method that is adaptable for use with different types, models, and sizes of IC engines.

Another object of the invention is to provide an internal combustion engine cleaning apparatus and method that is adaptable for use in cleaning a gasoline fueled IC type of an engine.

Still another object of the invention is to provide an internal combustion engine cleaning apparatus and method that is adaptable for use in cleaning a diesel fueled IC type of an engine.

Still yet another object of the invention is to provide an internal combustion engine cleaning apparatus and method that is adaptable for use in cleaning an IC engine subsystem that includes a fluid (or a combustion gas) such as the coolant, transmission, fuel, brake, power steering, differential, or hydraulic sub-systems.

Yet another important object of the invention is to provide an internal combustion engine cleaning apparatus and method that can lessen the time required to clean an IC engine or any of its sub-systems.

Still yet another important object of the invention is to provide an internal combustion engine cleaning apparatus and method that can lessen the cost of cleaning an IC engine or any of its sub-systems.

Still yet another important object of the invention is to provide an internal combustion engine cleaning apparatus and method that can better clean the interior portions of an IC engine or any of its sub-systems.

Still yet one other object of the invention is to provide an internal combustion engine cleaning apparatus and method that can be adapted for use to clean part of an IC engine or IC engine sub-system when the engine is shut off.

Still yet one other important object of the invention is to provide an internal combustion engine cleaning apparatus and method that can be adapted for use to clean part of an IC engine or IC engine sub-system when the engine is running, for example, as when cleaning the coolant sub-system.

Still yet one other further object of the invention is to provide an internal combustion engine cleaning apparatus and method that can be adapted for use to decarbonize an IC engine.

Still yet one other further important object of the invention is to provide an internal combustion engine cleaning apparatus and method that includes an ultrasonic transducer that is inserted through an orifice into contact with a fluid.

Still yet one other further especially important object of the invention is to provide an internal combustion engine cleaning apparatus and method that includes an ultrasonic transducer that is inserted through an orifice and into contact with a cleaning solution.

Still yet one other further useful object of the invention is to provide an internal combustion engine cleaning apparatus and method that includes ultrasonic cleaning waves in a fluid to effectively clean the interior portions of an IC engine without substantial engine disassembly.

Still yet one other further important and useful object of the invention is to provide an internal combustion engine cleaning apparatus and method that includes an electronic amplifier to supply power to an ultrasonic transducer.

Still yet one other further important and especially useful object of the invention is to provide an internal combustion engine cleaning apparatus and method that includes control circuitry to regulate the functioning of the cleaning apparatus.

Briefly, an internal combustion engine cleaning apparatus and method that is constructed in accordance with the principles of the present invention includes a transducer that emits ultrasonic energy. An adapter that holds the transducer is attached where desired to an IC engine so that the transducer imparts ultrasonic energy directly to a fluid that is contained within the IC engine or is part of any of the engine's sub-systems. The transducer is placed in direct contact with the fluid. For example, to clean the interior portions of the IC engine that are exposed to the lubricating oil sub-system, the transducer may be attached to an adapter that includes a portion of the transducer that passes through the oil pan drain hole so that it contacts the fluid. In this instance the engine oil is replaced temporarily by a cleaning solution and the transducer imparts ultrasonic energy to the cleaning solution thereby increasing the efficacy of the cleaning solution and cleaning process. The cleaning solution is later removed and the engine oil is replaced. A different transducer and a different adapter are used for different sizes and different types of IC engines, depending upon the specific requirements. Similarly, a different transducer and a different adapter are used to clean the various sub-systems of the IC engine.

DETAILED DESCRIPTION OF THE INVENTION

Figure 1:
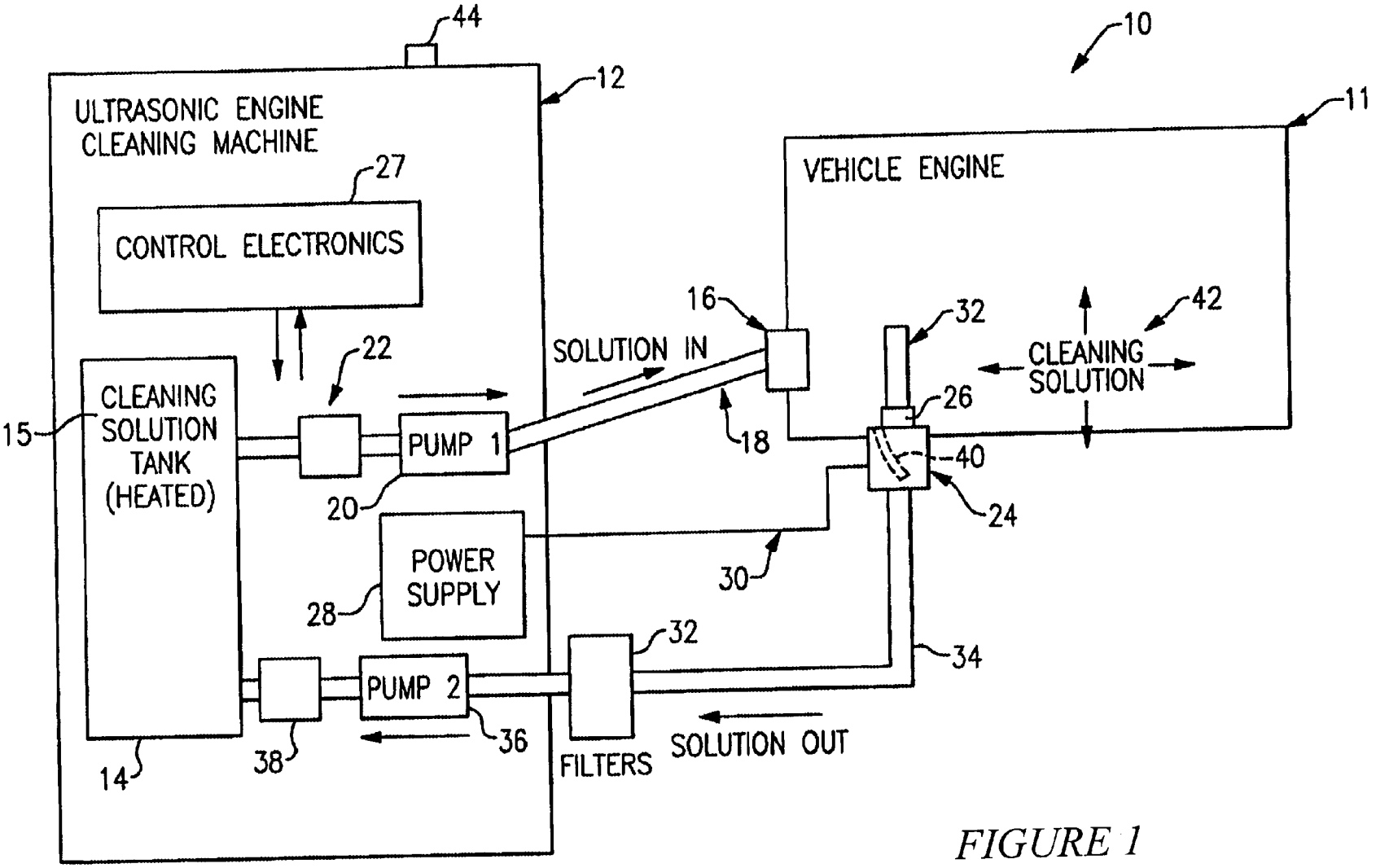
FIG. 1 is block diagrammatic view of an internal combustion engine cleaning apparatus and method.

Referring to FIG. 1 is shown, an internal combustion engine cleaning apparatus and method, identified in general by the reference numeral 10 for use in cleaning the interior portions of an internal combustion type of an engine, the engine being identified in general by the reference numeral 11.

The internal combustion engine cleaning apparatus and method 10 includes an ultrasonic engine cleaning machine, identified in general by the reference numeral 12.

The ultrasonic engine cleaning machine 12 includes a cleaning solution tank 14. Depending upon what part of the engine 11 is to be cleaned, a different type of a cleaning solution 15 is disposed in the cleaning solution tank 14 and is used.

The example shown in the FIG. 1 drawing illustrates use of the internal combustion engine cleaning apparatus and method 10 for the cleaning of the lubrication system (i.e., the motor or engine oil) of the engine 11. For this purpose, it is preferable to heat the cleaning solution 15 optimally to approximately 140 degrees Fahrenheit.

The cleaning solution 15 also contains lubricants, as is well known in the engine oil cleaning arts, so as to prevent a "dry start" of the engine 11. A dry start occurs when the engine's 11 lubricating system has been cleaned and contains no lubricants whatsoever.

Starting the engine 11 under these conditions results in moving metallic parts directly contacting other metallic parts in the engine 11 briefly until the fresh engine oil is circulated. This brief metal to metal contact can result in disproportionate engine wear and is therefore desirable to avoid. The use of lubricant additives to leave a residual lubricating film in the engine 11 after cleaning is complete is known for use with the cleaning solution 15.

Obviously, the cleaning solution 15 will include any other desirable agent or additive that is useful to cleaning whatever area of the engine 11 is being cleaned by the internal combustion engine cleaning apparatus and method 10.

Although the specification describes with specificity the cleaning of the engine oil lubrication system, it will become obvious to those possessing ordinary skill in the art as to how to adapt the internal combustion engine cleaning apparatus and method 10 for use with any of the sub-systems of the engine 11. It will also become obvious how to adapt the apparatus and method 10 for use regardless of the size or the type of the engine 11.

An oil filter adapter 16 is attached to the engine 11 at the location where the oil filter (not shown) was removed. An oil filter cleaning solution hose 18 is attached to the oil filter adapter 16 and extends to the ultrasonic engine cleaning machine 12 where it is used to supply the cleaning solution 15 to the engine 11 when desired.

A first pump 20 is controlled by a first solenoid 22 and when activated supply the heated cleaning solution 15 to the engine 11 through the oil filter adapter 16 under pressure, typically around 40–50 pounds per square inch.

An oil drain plug adapter 24 is attached to the engine 11 at the location where the oil drain plug (not shown) was removed. An ultrasonic transducer 26 is preferably included as a part of the oil drain plug adapter 24 or it is attached to the oil drain plug adapter 24 after the oil drain plug adapter 24 is installed.

The ultrasonic transducer 26 includes a power amplifier (or the power amplifier is contained as part of either a control electronics assembly 27 or a power supply 28 that are contained in the ultrasonic engine cleaning machine 12). A power line 30 (i.e., an electrical cable) is connected intermediate the power supply 28 in the ultrasonic engine cleaning machine 12 and the oil drain plug adapter 24 to supply power to the transducer 26.

The ultrasonic transducer 26 may include a flexible waveguide extension 32 that is useful for imparting ultrasonic energy where desired.

A filter assembly 32 is included as part of the ultrasonic engine cleaning machine 12 to filter and clean contaminants from the cleaning solution 15 prior to the cleaning solution 15 being delivered back to the cleaning solution tank 14.

An oil drain hose 34 is attached to the oil drain plug adapter 24 and to the filter assembly 32.

A second pump 36 is controlled by a second solenoid 38 and when activated, receives the cleaning solution 15 from the filter assembly 32 and, before that, from the oil drain plug adapter 24. The oil drain plug adapter 24 contains an opening 40 to permit fluid flow to occur through it.

Operation

1. The first step is to remove the engine drain plug and to drain and collect the old engine motor oil for disposal.
2. The second step is to remove and dispose of the old vehicle oil filter.
3. The third step is to install the oil filter adapter 16 and to connect the oil filter cleaning solution hose 18 to the oil filter adapter 16.
4. The fourth step is to install the ultrasonic transducer 26, possible waveguide extension 32, and the associated oil drain plug adapter 24 to the oil drain hole and to connect the oil drain hose 34 and the electrical power line 30 to their respective locations on the oil drain plug adapter 24.
5. The fifth step is to begin the cleaning cycle by pumping the cleaning solution 15 (having a preferred formulation) that is optimally preheated to approximately 140 degrees Fahrenheit into the engine 11 through the oil filter adapter 16.
6. The sixth step is to energize (i.e., to supply power to the transducer 26) for a period of time sufficient to effectively clean the engine 11. The transducer imparts ultrasonic energy of any preferred ultrasonic frequency (or variable range of frequencies such as by "sweeping" frequencies) to the cleaning solution 15 so as to rapidly and effectively clean the interior portions of the engine 11. The effect of the ultrasonic energy is shown generally by a group of four arrows identified in general by the reference numeral 42. The time range for this cycle is varied to satisfy the requirements and typically may include a range of from approximately one to five minutes duration. The duration for this cycle is determined by the various control panel settings that are manually selected or which are under program control by the control electronics 27. Once the settings are complete ideally a simple touch of a "start button 44" after all manual connections are complete will cause the machine 12 to perform all of the cleaning cycles automatically.

7. The seventh step is to end the cleaning cycle by recovering the bulk of the remaining cleaning solution 15 from the oil drain adapter 24. The cleaning solution 15 may be filtered by the filter assembly 32 and then stored for reuse back in the cleaning solution tank 14 or it may be replaced when desired with fresh cleaning solution (not shown).

8. The eight step is to remove the hoses 18, 34 and adapters 16, 24 and the transducer 26 and to install the vehicle's engine drain plug and a new oil filter and to add fresh oil.

The cleaning solution will contain some lubricants that remain in the engine 11 to provide a residual coating to prevent dry starts. If desired, the cleaning solution 15 cycle may be followed by repeating the process with a second rinse solution cycle that may, or may not, itself include the use of ultrasonic energy. The cleaning solution 15, rinse solution, filter screens and filter elements of the filter assembly 32 are replaced or are cleaned when and how desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for cleaning an internal combustion engine for use with either the cooling, transmission, power steering, differential, braking, or lubricating system, comprising:

(a) attaching an ultrasonic transducer proximate an opening in said engine that provides access for at least a portion of said ultrasonic transducer with an interior portion of said engine at a region in said engine that is bathed with either a cooling fluid, transmission fluid, brake fluid, or lubricating oil;

(b) contacting at least a portion of said ultrasonic transducer with a fluid that is disposed in said interior portion of said region in said engine; and (c) imparting ultrasonic energy to said fluid for a period of time.

2. The method of claim 1 including the step of adding said fluid to said interior portion prior to the step of contacting at least a portion of said ultrasonic transducer with said fluid.

3. The method of claim 2 wherein the step of adding said fluid includes adding a cleaning solution.

4. The method of claim 1 including the step of draining an existing fluid from said interior portion prior to the step of adding said fluid.

5. The method of claim 1 including the step of removing a first component from said engine so as to provide said opening prior to the step of attaching said ultrasonic transducer.

6. The method of claim 5 including the step of attaching a first adapter at a location in which said first component was removed prior to the step of attaching said ultrasonic transducer.

7. The method of claim 6 including the step of removing a second component from said engine so as to provide a second opening.

8. The method of claim 7 including the step of attaching a second adapter at said second opening.

9. The method of claim 8 including the step of attaching an ultrasonic cleaning machine to said first adapter and to said second adapter.

10. The method of claim 9 wherein the step of attaching includes the steps of attaching a first hose from said cleaning machine said first adapter and of attaching a second hose to said second adapter.

11. The method of claim 10, wherein said cleaning machine includes means for providing a circular path for said fluid to flow from said cleaning machine through said first adapter and for recovering said fluid through said second adapter.

12. The method of claim 10 including the step of pumping said fluid from said cleaning machine through said first adapter into said engine and of recovering said fluid from said second adapter.

13. The method of claim 12 including the step of heating said fluid prior to the step of pumping said fluid.

14. The method of claim 1 including the step of starting said engine prior to the step of imparting ultrasonic energy to said fluid.

15. The method of claim 1 wherein the step of imparting ultrasonic energy to said fluid includes the step of imparting ultrasonic energy to a fluid that is disposed in a sub-system of said engine.

16. A method for cleaning an internal combustion engine that is adapted for use with either the cooling, transmission, power steering, differential, braking, or lubricating system, comprising:

(a) attaching an ultrasonic transducer proximate an opening in said engine that provides access for at least a portion of said ultrasonic transducer with an interior portion of said engine;

(b) contacting at least a portion of said ultrasonic transducer with a fluid that is disposed in said interior portion of said engine cooling, transmission, power steering, differential, braking, or lubricating system;

(c) starting said engine; and (d) imparting ultrasonic energy to said fluid for a period of time.

* * * * *